United States Patent [19]

Fujiwhara et al.

[11] 4,137,080

[45] Jan. 30, 1979

[54] PROCESS FOR DYE IMAGE PRODUCTION ON A LIGHT-SENSITIVE SILVER HALIDE PHOTOGRAPHIC MATERIAL

[75] Inventors: Mitsuto Fujiwhara; Syunji Matsuo; Mikio Kawasaki; Yutaka Kaneko; Toyoaki Masukawa, all of Hino, Japan

[73] Assignee: Konishiroku Photo Industry Co., Ltd., Tokyo, Japan

[21] Appl. No.: 899,893

[22] Filed: Apr. 26, 1978

Related U.S. Application Data

[63] Continuation of Ser. No. 739,330, Nov. 5, 1976, abandoned.

[30] Foreign Application Priority Data

Nov. 7, 1975 [JP] Japan ..... 50-133879

[51] Int. Cl.[2] ..... G03C 7/00; G03C 5/30

[52] U.S. Cl. ..... 96/55; 96/66 R; 96/100 R

[58] Field of Search ..... 96/66 R, 66.3, 22, 55, 96/100

[56] References Cited

U.S. PATENT DOCUMENTS

| | | | |
|---|---|---|---|
| 2,304,953 | 12/1942 | Peterson | 96/66 R |
| 2,368,255 | 1/1945 | Lyon | 96/66 R |
| 3,300,305 | 1/1967 | Pesch et al. | 96/66 R |
| 3,415,651 | 12/1968 | von Konig | 96/66 R |
| 3,622,629 | 11/1971 | Lugosy | 96/66 R |

*Primary Examiner*—Mary F. Kelley
*Attorney, Agent, or Firm*—Bierman & Bierman

[57] ABSTRACT

There is disclosed a process for the production of a dye image on a silver halide photograhic material which comprises imagewise exposing the photographic material to light and then subjecting the photographic material to development in the presence of both a particular polyfunctional coupler and a particular polyfunctional developing agent.

3 Claims, No Drawings

PROCESS FOR DYE IMAGE PRODUCTION ON A LIGHT-SENSITIVE SILVER HALIDE PHOTOGRAPHIC MATERIAL

This is a Rule 60 Continuation Application of Ser. No. 739,330 filed on Nov. 5, 1976 now abandoned and which claims the priority of Japanese Patent Application No. 133879/1975 filed on Nov. 7, 1975.

This invention relates to a process for dye image production on a light-sensitive silver halide photographic material, wherein a black image is produced at exposed portions of the photographic material. More particularly, this invention is concerned with a process for dye image production on a light-sensitive silver halide photographic material, whereby it becomes possible to achieve an extreme saving in the amount of silver as well as an extreme increase in the maximum density.

Light-sensitive silver halide photographic materials are high in photosensitivity and excellent in image-forming ability, and hence have frequently been used for long. They, however, require large quantities of silver, so far as developed silver is used as a medium for image recording as is the case with the conventional silver halide photographic materials. However, recently shortage of silver resources and rise in cost of raw materials derived therefrom have come to be apparent and realized as serious problems for such silver halide photographic materials, and a demand for the development of techniques capable of saving the amount of silver required has become clamouraous. In order to meet the above-mentioned demand, a variety of proposals have been made. For example, there is proposed in U.S. Pat. No. 3,622,629 a method wherein a silver image and a black dye image are simultaneously formed at the exposed portion, thereby to reduce the amount of silver required. This is a method of image formation wherein there is used a so-called developer-coupler, having within the same molecule both a developer function and a dye-coupling function, i.e. method wherein the developer-coupler is developed to give an oxidation product which in turn is subjected to intermolecular reaction to form a polymeric dye causing blackening to give black-and-white images. This method of image formation by use of developer-couplers has been considered advantageous, to some extent, in that it provides black-and-white images at reduced amounts of silver. It, however, has a lot of serious drawbacks, some of the most serious ones being as follows:

(1) Since having both a developer portion and a coupler portion within the same molecule, the developer-couplers are easily subject to oxidation for example by oxygen in the air with the result that light-sensitive silver halide photographic materials processed therewith tend to undergo fogging and color staining.

(2) The way to use the developer-couplers is confined to that as developing agents, that is to say, it is not possible to incorporate them into silver halide emulsion layers of light-sensitive silver halide photographic materials, with the result that processing operation becomes complex.

(3) The storability of developing solutions containing the developer-couplers is extremely low.

(4) Synthesis of the developer-couplers is difficult due to interaction, in the course of the reaction of the active function at the coupler portion with the coupling function at the developer portion.

(5) The blackness of the images obtained by this method is close to a so-called neutral black color, but not a satisfactory one, which may lower commercial values depending upon the kind of use.

With a view to overcoming the above-enumerated drawbacks, we have made extensive studies and have now accomplished the present invention.

It is therefore a primary object of the present invention to provide a process for dye image production on a light-sensitive silver halide photographic material, whereby it becomes possible to achieve a saving in the amount of silver as well as an increase in the maximum density.

A still further object of the present invention is to provide a process for dye image production on a light-sensitive silver halide photographic material, whereby a black dye image can be formed which provides a satisfactory neutral black color.

A still further object of the present invention is to provide a process for dye image production on a light-sensitive silver halide photographic material, wherein couplers may be incorporated either into silver halide emulsion layers or into a developer solution thereby to make processing easier and whereby the storability of processing agents can be enhanced.

A still further object of the present invention is to provide a process for dye image production on a light-sensitive silver halide photographic material whereby fogging and color staining can be prevented to a great extent.

A still further object of the present invention is to provide a process for dye image formation on a light-sensitive silver halide photographic material whereby excellent granularlity can be ensured.

The above-mentioned objects as well as other objects of the present invention which will become apparent from the following description can be accomplished by adoption of a process for the production of an image on a light-sensitive silver halide photographic material, which comprises effecting development, after image-wise exposure, of the light-sensitive silver halide photographic material in the presence of both a polyfunctional coupler and a compound of the general formula I:

$$D_1 - A_1 - (D_2 - A_2)_{n-1} - D_3 \qquad (I)$$

wherein $D_1$ and $D_3$ each stand for a univalent p-aminophenol or p-phenylenediamine residue, $D_2$ stands for a bivalent p-aminophenol or p-phenylenediamine residue, $A_1$ and $A_2$ each represent a single bond or a bivalent organic residue and n is an integer of 1 or more.

The term "polyfunctional coupler" as used herein includes all the couplers that have within the same molecule two or more active portions capable of coupling with developing agents. There may be mentioned, for example, polyhydric phenols, polyamino compounds, aminophenols, bisphenols, bispyrazolones, open-chain ketomethylene compounds, etc. In addition, the polyfunctional couplers may be either so-called two-equivalent couplers or four-equivalent couplers. Alternatively they may be so-called polymer couplers.

In the present invention, as polyfunctional couplers, are preferable aminophenols and, in particular, a compound of the formula II:

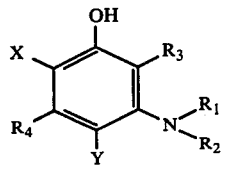

(II)

wherein $R_1$ and $R_2$ each represent a hydrogen, or substituted or unsubstituted, respectively, alkyl, alkenyl, aryl or heterocyclic radical, $R_3$ and $R_4$ each represent a univalent radical selected from a hydrogen, halogen, hydroxy, substituted or unsubstituted, respectively, alkyl, alkoxy and amino radicals, X and Y each represent a hydrogen, halogen, sulfo, mercapto, hydroxy, or substituted or unsubstituted, respectively, alkoxy, aryloxy, acyloxy, arylthio, arylseleno, amino, cyclic imido, carbamoyloxy, phenylsulfonyloxy or arylazo radical, with the proviso that at least one of X and Y represents such radical that is splittable at the coupling with an aromatic primary amine color developing agent.

According to one preferable embodiment of the present invention, a compound having at least one of X and Y in the above formula such a univalent radical other than hydrogen that can be split at the coupling reaction with an aromatic primary amine color developing agent (for example, a halogen, sulfo, alkoxy, aryloxy, acyloxy, benzenesulfonyloxy radical, etc.) enables, due to its structural characteristic, formation of a good black image at a less amount of silver in comparison with a compound wherein both X and Y represent hydrogens or a compound wherein either one of X and Y represents hydrogen and the other represents such radical that is not splittable at the coupling (for example, an amino, alkyl radical, etc.).

Representative examples of the polyfunctional couplers preferable for use in the present invention are shown in the following:

(C-1) Resorcin
(C-2) 2,2'-Dihydroxybiphenyl
(C-3) 5-Amino-α-naphthol
(C-4) N,N'-Bis(3-hydroxyphenyl)ethylenediamine
(C-5) 1-Phenyl-3-(1-hydroxy-2-naphthamido)pyrazolin-5-one
(C-6) N,N'-Bis[1-(4-sulfophenyl)-pyrazolin-5-one-3-yl]malondiamide
(C-7) α-Acetyl-3-hydroxyacetoanilide
(C-8) N,N'-Methylenebis(1-hydroxy-2-naphthamide)
(C-9) 2,2'-Methylenebis(8-hydroxyquinoline)
(C-10) 2,2'-Methylenebis[6-(2-hydroxyphenyl)-phenol]
(C-11) N,N'-Bis[2-hydroxy-4-(2',4'-di-tert.-amylphenoxyacetamido)phenyl]malondiamide
(C-12) 2,2'-Methylenebis(4-chlorophenol)
(C-13) 3,3'-Diphenylamine
(C-14) 3-Aminophenol
(C-15) 3-Anilinophenol
(C-16) 3-(N-Methyl)aminophenol The polyfunctional couplers used in accordance with the present invention can be easily prepared by methods known per se.

The compounds of the general formula I, i.e. polyfunctional developing agents, are developing agents which have within the same molecule two or more developer portions capable of coupling with couplers.

In the general formula I shown above, $D_1$ and $D_3$ each mean a univalent p-aminophenol or p-phenylenediamine residue, and they may be the same or different. As defined in the foregoing, $D_2$ stands for a bivalent p-aminophenol or p-phenylenediamine residue. $A_1$ and $A_2$ each represent a single bond or such an organic residue as to make the developing agent polyfunctional. As examples of such organic residues, these may be derived from alkylenes, arylenes, ethers, sulfides, amines, amides, alkyl ethers, aryl ethers, alkylamines, alkylaryls, carbonyls, peptides, etc. It is to be understood that $D_1$, $D_2$ and $D_3$ must not bear substituents in positions having the developer function of coupling with couplers.

Among compounds represented by the general formula I, those wherein $D_1$ and $D_3$ each represents a bivalent p-phenylenediamine residue are preperable and in particular is preferable a compound wherein $A_1$ and $A_2$ each represent a single bond or an alkylene, arylene, sulfido, amino, alkylether, arylether, alkylamino, alkylaryl or carbonyl group.

As representative examples of the compounds of the general formula I according to the present invention (said compounds being hereinafter referred to as polyfunctional developing agents), there may be mentioned the following:

(D-1) N,N'-Ethylenebis(3-methyl-4-amino-N-methylaniline)
(D-2) β,β'-Oxybis[β-(N-ethyl-4-aminoanilino)ethyl]-ether
(D-3) N,N'-Ethylenebis[4-amino-N-(β-hydroxyethyl)aniline]
(D-4) 4-Amino-N-ethyl[β-(4'-amido-N'-ethylanilino)-propionic acid]anilide
(D-5) 2,2'-Methylenebis(p-phenylenediamine)
(D-6) 2-Amino-5-[N-ethyl-N-(β-methoxyethyl)-]aminophenethyl{2-amino-5-[N-ethyl-N-(β-methoxyethyl)]}aminobenzylsulfonamide
(D7) N[2-(N,N-diethylamino)-5-aminophenethyl]-2-amino-5-(N,N-diethylamino)phenylaniline
(D-8) 2-[β-{2-amino-5-(N,N-diethylamino)phenoxy}ethyl]-4-amino-N,N-diethylaniline
(D-9) Bis(2-hydroxy-5-aminobenzyl)amine
(D-10) 2,2'-Methylenebis(p-aminophenol)
(D-11) N(2'-hydroxy-5'-aminophenyl)-2-hydroxy-5-aminobenzylamine
(D-12) α,α'-(Ethylenediimino)-bis-(4-amino-o-cresol)
(D-13) 3-Methyl-4-amino-N-ethyl-N-(2-hydroxy-5-aminobenzyl)aniline
(D-14) α,α'-Oxybis(4-amino-o-cresol)
(D-15) 5-Aminosalicylic acid (2-amino-5-hydroxy)anilide
(D-16) 2,2'-Disulfidebis(p-aminophenol)
(D-17) 2,6-Bis(2-hydroxy-3-methyl-5-aminobenzyl)-3,5-dimethyl-4-aminophenol The polyfunctional developing agents according to the present invention can be easily synthesized by methods known per se, some preferable examples of such synthesis being shown in the following.

1. SYNTHESIS OF EXEMPLIFIED COMPOUND (D-2)

(a) Synthesis of Diethylene glycol-di-p-toluenesulfonate 10.6 g. of diethylene glycol was dissolved in 40 ml. of pyridine. To the resulting solution was added 38 g. of p-toluenesulfonyl chloride in small portions while keeping the reaction temperature below 20° C. After three hours, the resulting reaction mixture was poured into a mixture of ice and an aqueous hydrochloric acid solution thereby to have white crystals precipitated. The crystals were recrystallized from methanol to obtain the end product in the form of white flaky crystals melting at 89° C. The yield was 25 g.

(b) Synthesis of β,β'-Oxybis(N,N-diethylaniline)

20 ml. of a 20% aqueous caustic soda solution was added to 9.6 g. of N-ethylaniline. To the mixture was added 16.5 g. of ethylene glycol-di-p-toluenesulfonate in small portions, while keeping the temperature at 60°-70° C. The reaction temperature was slowly raised until it was 100° C. after 5 hours. The reaction mixture was stirred for further 3 hours. Thereafter it was cooled and extracted with ether to obtain the end product in the form of a yellowish white liquid having a boiling point of 210°-220° C. The yield was 5.5 g.

(c) Synthesis of β,β'-Oxybis(4-amino-N,N-diethylaniline)hydrochloride 3.1 g. of bis-β-(N-ethylanilino)ethyl ether was dissolved in a small amount of methanol and the solution was charged with 5 ml. of hydrochloric acid. While keeping the temperature below 5° C., 1.55 g. of sodium nitrite was added in small portions to the resulting mixture. After the addition was complete, the mixture was stirred for an hour. To the mixture was then added 3.3 g. of reduced iron powder in small portions while keeping the reaction temperature at 15°-20° C. The reaction mixture was stirred for further one hour, adjusted to a pH of 8-8.5 and extracted with ethyl acetate. Approximately three-fourths of the ethyl acetate in the extract was distilled off, and a mixture of methanol and an aqueous hydrochloric acid solution was slowly added dropwise to the residue to have crystals, white to pink in color, precipitated slowly, which crystals were then collected by filteration to obtain the end product. The melting point and yield of the end product were 190°-230° C. (decomp.) and 4.0 g., respectively.

2. SYNTHESIS OF EXEMPLIFIED COMPOUND (D-9)

(a) Synthesis of Bis(2-hydroxy-5-nitrobenzyl)amine

A mixture of 30 g. of p-nitrophenyl and 6 g. of hexamethylenetetramine was heated at 100° C. to form a melt thereof, which, after allowed to stand for about an hour, began to crystallize to give yellow crystals. Four hours after that, 100 ml. of a hot alcohol was added to the crystals to triturate them therewith. The thus treated crystals were cooled, filtered, and washed with 200 ml. of an alcohol to obtain the end product in the form of yellow powder. The melting point and yield of the end product were 260°-270° C. (decomp.) and 20 g., respectively.

(b) Synthesis of Bis(2-hydroxy-5-aminobenzyl)amine hydrochloride

The crude bis(2-hydroxy-5-nitrobenzylamine) was added, together with 2.5 g. of palladium/C as catalyst, to a mixture of 150 ml. of an alcohol and 15 ml. of concentrated hydrochloric acid, and the resulting mixture was subjected to catalytic reduction at normal pressure for 24 hours. The reaction mixture was then filtered to remove the catalyst and the filtrate was concentrated to have crystals precipitated. The crude product was recrystallized from an alcohol in the form of white crystals. The end product did not show a definite melting point but was decomposed slowly at 180°-220° C. The yield was 10 g.

3. SYNTHESIS OF EXEMPLIFIED COMPOUND (D-11)

(a) Synthesis of N-(2'-Hydroxy-5'-nitrophenyl)-2-hydroxy-5-nitrobenzylamine 15.4 g. of 2-amino-4-nitrophenol and 8.2 g. of sodium acetate were added to 200 ml. of an alcohol and the mixture was heated under reflux. To the mixture was added dropwise 19.6 g. of 2-hydroxy-5-nitrobenzyl chloride dissolved in 70 ml. of an alcohol over a period of time of 30 minutes. After the reaction was effected for about 2 hours, the alcohol was distilled off. The reaction mixture was extracted with ethyl acetate and the extract was washed with water and concentrated by distilling off the ethyl acetate to have crystals precipitated. The crystals were recrystallized from 250 ml. of acetonitrile to obtain the end product. The melting point of the end product was 170°-220° C. (decomp.) and the yield was 24 g.

(b) Synthesis of N-(2'-Hydroxy-5'-aminophenyl)-2-hydroxy-5-aminobenzylamine trihydrochloride 16 g. of N-(2'-hydroxy-5'-nitrophenyl)-2-hydroxy-5-nitrobenzylamine was dissolved in 150 ml. of methanol. After addition of 2 g. of palladium/C as catalyst, the catalytic reduction was effected for about 3 hours. The precipitated crystals were dissolved in concentrated hydrochloric acid and filtered. The filtrate was concentrated, charged with 100 ml. of an alcohol and heated for 2 hours to obtain the end product in the form of white crystals. The melting point of the end product was 200°-240° C. (decomp.), and the yield was 12 g.

In the dye image production process according to the present invention, the image may be formed with both a black dye image and a silver image, or it may be formed with a black dye image alone by desilvering silver images. Even in the case of forming an image with both a black dye image and a silver image, it is possible to obtain a high density image with a reduced amount of silver.

In carrying out the process of the invention, a light-sensitive silver halide photographic material is developed, after imagewise exposure, in the presence of the above-mentioned polyfunctional coupler and polyfunctional developing agent. The location of the polyfunctional couplers and polyfunctional developing agents is not critical, that is to say, they may be present anywhere. Thus, for example, when it is desired to use a polyfunctional coupler which is diffusible, the coupler, of course, may be incorporated into light-sensitive photographic materials or into developer solutions. In the case of incorporating the coupler into a light-sensitive photographic material, it is possible to incorporate it into the emulsion layer or non-emulsion layer (for example, inter layer) of said light-sensitive photographic material. These diffusible polyfunctional couplers may be added in the form of solutions in water or water-soluble organic solvents. On the other hand, when it is desired to use a polyfunctional coupler which is non-diffusible, it may be protect-dispersed and then added to a silver halide photographic emulsion. The protect-dispersion may be carried out for example by such methods as disclosed in U.S. Pat. Nos. 2,322,027, 2,801,170, 2,801,171, 2,272,191, and 2,304,940. According to these methods, the polyfunctional coupler to be used is dissolved in a high boiling solvent such as, for example, organic acid amide derivatives, esters, ketone derivatives, phenol esters, phosphate esters, sulfonamide derivatives and urea derivatives, especially in such a high boiling solvent as di-n-butyl phthalate, tricresyl phosphate, diisooctyl azelate, di-n-butyl sebacate, tri-n-hexyl phosphate, N,N-diethylcaprylamide, n-pentadecyl phenyl ether or a fluorinated paraffin, optionally using a low boiling solvent such as, for example, ethyl acetate, butyl acetate, butyl propionate, propylene carbonate, cyclohexanol, cyclohexane or tetrahydrofuran. The high boiling solvents and low boiling solvents may be used either singly or as mixtures of two or more of them. The resulting solution is then admixed with an aqueous solution of a hydrophillic binder such as gelatin, which solution contains an anionic surface active agent such as alkylbenzenesulfonic acids or alkylnaphthalenesulfonic acids, and/or a nonionic surface active agent such as sorbitan sesquioleic acid ester or sorbitan monolauric acid ester, and dispersed by means of a high speed rotary mixer, a colloid mill or a supersonic dispersing unit. The resulting coupler solution is finally added to a silver halide photographic emulsion.

The polyfunctional developing agents according to the present invention are preferably incorporated into developer solutions, although they may be, even in the case of using light-sensitive photographic emulsions having incorporated therein the polyfunctional couplers, incorporated into the light-sensitive photographic emulsions in such manner that the developing agents exert no adverse effects on the materials up to development thereof. These polyfunctional developing agents may be added in the form of solutions in water or water-soluble organic solvents.

When the polyfunctional couplers and polyfunctional developing agents in accordance with the present invention are added to developer solutions, the order of addition is not critical, that is to say, they may be added while preparing the developer solutions, or may be mixed together at the stage of development and added to the processing solutions.

The amounts of the polyfunctional couplers of the invention used are not critical, although, in general, the couplers are added in amounts of about 1–20 mg/cm$^2$ when incorporated into light sensitive silver halide photographic materials, and in such amounts, when incorporated into developer solutions, that the amounts of the couplers to be transferred upon development into light-sensitive silver halide photographic materials correspond to 1–20 mg/cm$^2$.

The amounts of the polyfunctional developing agents in accordance with the present invention are not critical, although, in general, the developing agents are used in amounts of 1–50 g/l, preferably 5–20 g/l when incorporated into processing solutions, and in sufficient amounts, when incorporated into light-sensitive silver halide photographic materials, to couple with the polyfunctional couplers, preferably in amounts of 0.5–30 mg/cm$^2$.

The ratios of the polyfunctional couplers to the polyfunctional developing agents are not critical but vary depending upon the mode of addition of them as exemplified above, although they are preferably so selected as to cause coupling between the couplers and developing agents, being, in general, 0.5–2.0 to 1, preferably 1 to 1.

The polyfunctional developing agents according to the present invention reduce, upon development, exposed silver halide to silver image and at the same time they themselves undergo oxidation to form oxidation products, which in turn couple with the polyfunctional couplers to form dyes. The thus formed dyes are polymeric ones since both the oxidized developing agents and the couplers have more than two functional groups within the same molecule. There is thus obtained a neutral black color of excellent blackness. Furthermore, the resulting black dye image is characterized by having covering power which is more than several times as high as that of silver image. As a consequence, the amount of silver required can be reduced to a great extent, and since even invisible silver image is amplified and made visible there is shown an increase in photosensitivity. Furthermore, in accordance with the present invention, even in the case where both the polyfunctional couplers and the polyfunctional developing agents are present in developer solutions, the developer solutions exhibit extremely excellent stability, withstand storage over a long period of time and have the effect that, after development therewith of light-sensitive silver halide photographic materials, they hardly cause fogging or color staining.

The polyfunctional developing agents according to the present invention may be used in combination with the conventional developing agents as auxiliary developing agents, for example, metol, phenidone and hydroquinone. In this case, the amounts of such auxiliary developing agents are not critical, although it suffices to add them in amounts of 0.1–15 g. per liter of the developer.

The developers which are used in accordance with the present invention may contain a variety of additives for different purposes. They may contain, for example, alkali agents such as sodium hydroxide, ammonium hydroxide, sodium carbonate, sodium sulfate or sodium sulfite, development inhibitors such as alkali metal halides (e.g. potassium bromide) and/or solubilizing agents such as benzyl alcohol, optionally together with water softening agents, development accelerators, pH adjusting agents, etc. The pH's of the developers according to the present invention are commonly 7 or higher, preferably in the range of from 9 to 11, regardless of the locations of the polyfunctional couplers and polyfunctional developing agents.

As mentioned in the foregoing, the image production process according to the present invention includes both cases of forming images with black dye images and silver images and cases of forming images with black dye images alone, so that it is possible, after development processing, to apply any suitable aftertreatments for different purposes of the respective cases. Thus, for example, in the former cases, a typical example of after-treatment involves fixing and water washing optionally with stopping and stabilizing added. In the latter cases, where images are formed with black dye images alone, a typical example of after-treatment involves bleaching, fixing and water washing; bleaching, water washing, fixing, water washing and stabilizing; or bleach-fixing, water washing and stabilizing.

The process according to the present invention can be effectively combined with so-called amplification processing, by which combination there can be achieved a further saving in the amount of silver. Thus, in the case of using, in the process of the present invention, developers containing oxidizing agents which bring metallic silver images into redox reaction, the polyfunctional developing agents are, by the presence of said oxidizing agents, oxidized in accordance with preceding imagewise exposure and then coupled with the polyfunctional couplers to form black dye images. As an example of oxidizing agent preferable for use in the present invention, there may be mentioned an aqueous hydrogen peroxide solution, as disclosed in Japanese Patent Application No. 80321/74. In this case, the concentration of the aqueous hydrogen peroxide solution varies depending upon the kind of the light-sensitive silver halide photographic material, the kind of the polyfunctional developing agent, etc., although it is in general in the range of from 0.01 to 10%, preferably from 0.5 to 5%. As other examples of oxidizing agent also preferable for use in the present invention, there may be mentioned hexavalent cobalt (III) complex salts, as disclosed in Japanese Laying Open-to-Public No. 9729/73. When these hexavalent cobalt (III) complex salts are to be used in the process of the present invention, it is desirable to use them in general in amounts in the range of from 0.2 to 20 g/l, preferably from 1 to 15 g/l, and at pH's in the range of from 6 to 14, preferably from 8 to 12.

Reference is now made to light-sensitive silver halide photographic materials which can be used in the process according to the present invention. The image production process of the invention can be applied to any of the conventional light-sensitive silver halide black-and-white photographic materials for varied uses, for example, general black-and-white photography, X-ray photography, lithography, microphotography, etc. Examples of silver halides which are used in preparation of the photographic materials are silver chloride, silver bromide, silver iodide, silver chlorobromide, silver iodobromide and silver chloroiodobromide, which may be used either alone or in admixture of two or more. Preparation of silver halide emulsions therewith can be carried out by any of the known procedures. These silver halide emulsions, if necessary, may be chemically sensitized by use of noble metal sensitizers, sulfur sensitizers, selenium sensitizers, etc., either alone or in proper combination (for example, combination of gold sensitizer with sulfur sensitizer, or combination of gold sensitizer with selenium sensitizer). General procedure for preparing silver halide emulsion layers on a support involves mixing one, or more of the silver halides with a known hydrophillic binder (for example, gelatin, phthalated gelatin, polyvinyl alcohol etc., which may be used either alone or in combination), to ripen the silver halide(s) and coating the resulting emulsion on a support, if necessary with sub layer, inter layer and/or protective layer interposed between the emulsion layer and the support. The silver halide emulsions may contain any of the conventional photographic additives, for example, coating aids such as saponin, alkylarylsulfonic acids or sulfoalkylsuccinic acids, hardeners such as aldehydes, ethyleneimines or vinyl sulfones, plasticizers such as glycerin or 1,5-pentanediol, sensitizing dyes such as cyanine dyes or merocyanine dyes, anti-static agents, anti-stain agents, etc.

As examples of supports for the silver halide emulsions used in the present invention, there may be mentioned nitrocellulose film, acetylcellulose film, polyvinyl acetal film, polycarbonate film, polystyrene film, polyethylene phthalate film, glass, baryta paper, polyethylene laminated paper etc., which, if necessary, may be subjected to subbing prior to use.

The present invention is illustrated in further detail below with reference to examples, but modes of practice of the invention are not limited to these examples.

EXAMPLE 1

A silver iodobromide emulsion containing 5 mole percent silver iodide for use in an ordinary black-and-white negative was coated on a cellulose triacetate film in one of the indicated amounts in Table 1 shown below, and on the resulting emulsion layer was coated a gelatin protective layer.

Table 1

| Sample | Silver, mg/100 cm$^2$ | Gelatin, mg/100 cm$^2$ |
|---|---|---|
| A | 40 | 75 |
| B | 20 | 50 |

Thereafter, each of the thus obtained samples was exposed through an optical wedge and developed at 20° C. for 6 minutes with the following developer.

| Developer: | |
|---|---|
| Metol | 2.5 g. |
| Anhydrous sodium sulfite | 30.0 g. |
| Hydroquinone | 2.5 g. |
| Sodium carbonate monohydrate | 10.0 g. |
| Potassium bromide | 0.5 g. |
| Water to make | 1 liter |

Subsequently, samples A and B were individually subjected to the conventional stopping, fixing and water washing treatments to provide samples 1 and 2, respectively.

Separately, another sample B was exposed and developed at 20° C. for 2.5 minutes using a developer prepared by mixing solution A with solution B and adjusting the resulting mixture to a pH of 11.0, the solutions A and B being of the following compositions.

| Solution A | |
|---|---|
| Exemplified compound (D-3) | 4.0 g. |
| Anhydrous sodium sulfite | 25.0 g. |
| Sodium carbonate monohydrate | 20.0 g. |
| Potassium bromide | 0.5 g. |
| Diethylene glycol | 8 ml. |
| Water to make | 1 liter |
| Solution B | |
| Exemplified compound (C-1) | 3.5 g. |
| Ethyl alcohol | 50 ml. |

After the development, it was subjected to the same treatments as in the case of the above-mentioned samples 1 and 2 to obtain sample 3. The light sensitivities, gammas, fogs and maximum densities ($D_{max}$) of these three samples were determined. The results obtained are shown in Table 2. The light sensitivities are shown in terms of relative speeds based on 100 for sample 1, which applies to the examples which follow this example.

Table 2

| Sample | Relative speed | Gamma | Fog | $D_{max}$ |
|---|---|---|---|---|
| 1 | 100 | 0.46 | 0.04 | 2.7 |
| 2 | 66 | 0.22 | 0.04 | 1.0 |
| 3 | 115 | 0.44 | 0.10 | 2.6 |

As can be clearly seen from the results shown in Table 2, sample 3, processed in accordance with the process of the present invention, shows much the same maximum density as and higher light sensitivity than sample 1, notwithstanding the fact that the amount of silver used in sample 1 is half of that used in sample 1.

EXAMPLE 2

A low speed silver chloroiodide emulsion containing 70 mole percent silver chloride for use in lithography was coated on a cellulose triacetate film in one of the indicated amounts in Table 3 shown below, and on the resulting emulsion layer was coated a gelatin protective layer.

Table 3

| Sample | Silver, mg/100 cm$^2$ | Gelatin, mg/100 cm$^2$ |
|---|---|---|
| A | 50 | 26 |
| B | 20 | 20 |

Thereafter, a screen negative was superposed on each of the samples and exposure was carried out using a printer. The exposed samples were individually developed at 20° C. for 2.5 minutes using a developer of the following composition.

| Developer: | |
|---|---|
| Metol | 1.5 g. |
| Anhydrous sodium sulfite | 23.0 g. |
| Hydroquinone | 6.0 g. |
| Sodium carbonate monohydrate | 41.0 g. |
| Potassium bromide | 1.0 g. |
| Water to make | 1 liter |

Subsequently, samples A and B were individually subjected to the conventional fixing and water washing treatments to provide samples 1 and 2, respectively.

Separately, sample B was exposed and developed with a developer consisting of a mixture of solutions A and B of the following compositions.

| Solution A | |
|---|---|
| Exemplified compound (D-12) | 8.0 g. |
| Anhydrous sodium sulfite | 20.0 g. |
| Sodium carbonate monohydrate | 40.0 g. |
| Potassium bromide | 1.5 g. |
| 1-Phenyl-3-pyrazolidone | 0.3 g. |
| Water to make | 1 liter |
| Solution B | |
| Exemplified compound (C-12) | 5.0 g. |
| Ethyl alcohol | 50 ml. |

After the development, it was subjected to the same treatments as in the case of the above-mentioned samples 1 and 2 to prepare sample 3.

Sample 2, which contained silver in the amount corresponding to two-fifths the usual amount as in sample 1 and was subjected to the conventional development processing, was found to be low in dot density and unsatisfactory in dot quality. In contrast to this, sample 3, which also contained silver in the amount corresponding to two-fifths the usual amount as in sample 1 and was subjected to the development processing according to the present invention, showed much the same dot density and dot quality as sample 1.

EXAMPLE 3

A silver iodobromide emulsion containing 1.5 mole% silver iodide for use in roentogenography was coated on a polyester film at a coverage of 40 mg/100 cm$^2$ of silver and 40 mg/100 cm$^2$ of gelatin, and on the resulting emulsion layer was coated a gelatin protective layer. The thus obtained photographic material was exposed through a wedge in the conventional manner, developed at 20° C. for 5 minutes in a developer of the following composition and subjected to the conventional fixing and water washing treatments to provide sample 1.

| Developer: | |
|---|---|
| Anhydrous sodium sulfite | 60.0 g. |
| 1-Phenyl-3-pyrazolidone | 0.25 g. |
| Hydroquinone | 5.0 g. |
| Anhydrous sodium carbonate | 25.0 g. |
| Potassium bromide | 4.0 g. |
| Benzotriazole | 0.3 g. |
| Caustic soda | 2.5 g. |
| Water to make | 1 liter |

Separately, another photographic material prepared in the same manner as described above was exposed in the same way as described above, developed at 20° C. for 5 minutes with a developer consisting of a mixture of solutions A and B of the following compositions, and thereafter subjected to the same treatments as in the case of sample 1 to provide sample 2.

| Solution A: | |
|---|---|
| Exemplified compound (D-1) | 5.0 g. |
| Anhydrous sodium sulfite | 25.0 g. |
| Anhydrous sodium carbonate | 50.0 g. |
| Potassium bromide | 3.0 g. |
| Diethylene glycol | 50 ml. |
| Water to make | 1 liter |
| Solution B: | |
| Exemplified compound (C-2) | 3.0 g. |
| Ethyl alcohol | 100 ml. |

The same determination as in Example 1 was made on each of samples 1 and 2. The results obtained are shown in Table 4.

Table 4

| Sample | Relative speed | Gamma | Fog | $D_{max}$ |
|---|---|---|---|---|
| 1 | 100 | 1.2 | 0.03 | 1.1 |
| 2 | 115 | 2.6 | 0.04 | 2.3 |

As can be clearly seen from the results shown in Table 4, sample 2 which was processed in accordance with the process of the invention is higher both in $D_{max}$ and in photosensitivity than control sample 1. Furthermore, sample 2 shows a dye image which is neutral black in blackness.

EXAMPLE 4

The same procedure as in the case of sample 2 in Example 3 was followed, except in that there was used exemplified compound (D-4) instead of the exemplified compound (D-1). There were obtained the following good results: $D_{max}$ 2.2, relative speed 120.

EXAMPLE 5

A sample was prepared, exposed and processed in the same manner as in Example 3, except in that the exposed sample was developed at 20° C. for 4 minutes using a developer of the following composition. The resulting sample is hereinafter referred to as sample 1.

| Developer: | |
|---|---|
| Anhydrous sodium sulfite | 72.0 g. |
| Metol | 2.2 g. |
| Hydroquinone | 8.8 g. |
| Anhydrous sodium carbonate | 50.0 g. |
| Potassium bromide | 4.0 g. |

-continued

| Developer: | |
|---|---|
| Water to make | 1 liter |

Two more samples were prepared and exposed in the same manner as in Example 3. One of the sample was developed at 20° C. for 4 minutes using a developer consisting of a mixture of solutions A and B of the compositions shown below, and then subjected to the conventional fixing and water-washing treatments to provide sample 2. The other sample was developed in the same manner as in the case of sample 2 and subjected to the conventional bleaching, fixing and water washing treatments to provide sample 3.

| Solution A | |
|---|---|
| Exemplified compound (D-2) | 10.0 g. |
| Anhydrous sodium sulfite | 20.0 g. |
| Anhydrous sodium carbonate | 80.0 g. |
| Potassium bromide | 1.0 g. |
| Water to make | 1 liter |
| Solution B | |
| Exemplified compound (C-8) | 8.0 g. |
| Ethyl alcohol | 100 ml. |

The relative speed, fog and maximum density were determined on each of the samples. The results obtained are shown in Table 5.

Table 5

| Sample | Relative speed | Fog | $D_{max}$ |
|---|---|---|---|
| 1 | 100 | 0.04 | 1.5 |
| 2 | 122 | 0.08 | 3.0 |
| 3 | 103 | 0.05 | 2.2 |

As can be clearly seen from the results shown in Table 5, samples 2 and 3 are higher in maximum density than control sample 1, and it is to be especially noted that sample 3 with an image consisting exclusively of a dye image is of higher muximum density than sample 1 consisting exclusively of a silver image. All of the three samples were nutral black in blackness.

EXAMPLE 6

A sample was prepared, exposed and processed in the same manner as in Example 3, except in that the exposed sample was developed at 20° C. for 3.5 minutes using a developer of the following composition. The resulting sample is hereinafter referred to as sample 1.

| Developer: | |
|---|---|
| Anhydrous sodium sulfite | 60.0 g. |
| Potassium metabisulfite | 0.3 g. |
| 1-Phenyl-3-pyrazolidone | 0.3 g. |
| Hexametaphosphoric acid disodium salt | 2.0 g. |
| Hydroquinone | 15.0 g. |
| Potassium nitrate | 0.2 g. |
| Benzotriazole | 0.1 g. |
| Potassium bromide | 3.0 g. |
| Ethylenediaminetetraacetic acid disodium salt | 1.0 g. |
| Anhydrous sodium carbonate | 50.0 g. |
| Water to make | 1 liter |

Another sample was prepared and exposed in the same manner as in Example 3, and developed at 20° C. for 3.5 minutes using a developer consisting of a mixture of solutions A and B of the following compositions. The resulting sample is hereinafter referred to as sample 2.

| Solution A: | |
|---|---|
| Exemplified compound (D-9) | 6.0 g. |
| Anhydrous sodium sulfite | 20.0 g. |
| Anhydrous sodium carbonate | 20.0 g. |
| Caustic soda | 2.5 g. |
| Potassium bromide | 3.5 g. |
| Water to make | 1 liter |
| Solution B: | |
| Exemplified compound (C-12) | 8.0 g. |
| Ethyl alcohol | 80 ml. |

Measurements of fog and maximum density were made on each of the samples. The results obtained are shown in Table 6.

Table 6

| Sample | Fog | $D_{max}$ |
|---|---|---|
| 1 | 0.04 | 1.4 |
| 2 | 0.06 | 3.3 |

It can be clearly seen from the results shown in Table 6 that sample 2 processed in accordance with the present invention exhibits the high maximum density.

EXAMPLE 7

A sample was prepared, exposed and developed in the same manner as in Example 6, except in that the development was carried out using a developer prepared by mixing, instead of the solution A employed in Example 6, solution A of the composition shown below with the same solution B as used in Example 6.

| Solution A: | |
|---|---|
| Exemplified compound (D-11) | 5.0 g. |
| Anhydrous sodium sulfite | 50.0 g. |
| Anhydrous sodium carbonate | 30.0 g. |
| Caustic soda | 1.5 g. |
| Potassium bromide | 3.0 g. |
| Water to make | 1 liter |

The thus processed sample gave the values for fog and maximum density of 0.08 and 3.2, respectively.

EXAMPLE 8

A sample was prepared, exposed, developed and after-treated in the same manner as for the sample A in Example 1, except in that the development was carried out at 30° C. for 1.5 minutes using the developer shown below. The thus obtained sample is hereinafter referred to as sample 1.

| Developer: | |
|---|---|
| Anhydrous sodium sulfite | 60.0 g. |
| Potassium metabisulfite | 0.3 g. |
| 1-Phenyl-3-pyrazolidone | 0.3 g. |
| Hexametaphosphoric acid disodium salt | 2.0 g. |
| Hydroquinone | 15.0 g. |
| Potassium nitrate | 0.2 g. |
| Benzotriazole | 0.1 g. |
| Potassium bromide | 3.0 g. |
| Ethylenediaminetetraacetic acid disodium salt | 1.0 g. |
| Anhydrous sodium carbonate | 50.0 g. |
| Water to make | 1 liter |

Another sample was prepared, exposed, developed and after-treated in the same manner as for the sample A in Example 1, except in that the development was carried out at 30° C. for 1.5 minutes using a developer consisting of a mixture of solutions A and B of the compositions shown below. The thus obtained sample is hereinafter referred to as sample 2.

| | |
|---|---|
| Solution A: | |
| Exemplified compound (D-10) | 13.0 g. |
| Anhydrous sodium sulfite | 50.0 g. |
| 1-Phenyl-3-pyrazolidone | 0.2 g. |
| Benzotriazole | 0.1 g. |
| Potassium bromide | 2.5 g. |
| Ethylenediaminetetraacetic acid disodium salt | 1.0 g. |
| Anhydrous sodium carbonate | 30.0 g. |
| Caustic soda | 2.0 g. |
| Diethylene glycol | 10 ml. |
| Water to make | 1 liter. |
| Solution B. | |
| Exemplified compound (C-13) | 10.0 g. |
| Ethyl alcohol | 100 ml. |

Measurements of photographic properties as in Example 1 were made on each of the samples. The results obtained are shown in Table 7.

Table 7

| Sample | Relative speed | Gamma | Fog | $D_{max}$ |
|---|---|---|---|---|
| 1 | 100 | 1.3 | 0.02 | 1.2 |
| 2 | 120 | 2.8 | 0.03 | 3.2 |

It can be clearly seen from the results shown in Table 7 that the sample processed in accordance with the present invention shows increased speed, gamma and $D_{max}$ as compared with the sample of the same silver content processed in the conventional manner. The blackness of sample 2 in accordance with the present invention was as neutral black as control sample 1.

EXAMPLE 9

A 1.3 mole% silver iodide-containing silver iodobromide emulsion for roentogenographic use was coated on a polyester film at a coverage of 30 mg/100 cm$^2$ of silver and 20 mg/100 cm$^2$. On the resulting emulsion layer was coated a gelatin protective layer. The above-described coupler was used in the form of a dispersion prepared by dissolving exemplified compound (C-11) in dibutyl phthalate (DBP) followed by protect-dispersing the solution using sodium dedecylbenzenesulfonate as dispersing agent.

The resulting photographic material was then exposed through a wedge in the conventional manner, developed at 20° C. for 4 minutes in a developer of the composition shown below and subjected to the conventional fixing and water washing treatments. The resulting sample is hereinafter referred to as sample 2.

| | |
|---|---|
| Developer: | |
| Exemplified compound (D-13) | 5.0 g. |
| Anhydrous sodium sulfite | 30.0 g. |
| Anhydrous sodium carbonate | 40.0 g. |
| Caustic soda | 1.0 g. |
| Potassium bromide | 3.0 g. |
| Diethylene glycol | 8 ml. |
| Water to make | 1 liter |

Another sample was prepared and exposed in the same manner as described above, developed at 20° C. for 4 minutes in a developer of the same composition as that of the developer used for the preparation of sample 1 in Example 5, and subjected to the conventional fixing and water washing treatments. The resulting sample is hereinafter referred to as sample 1.

Measurements of maximum density were made on each of the samples. The results obtained are shown in Table 8.

Table 8

| Sample | $D_{max}$ |
|---|---|
| 1 | 1.2 |
| 2 | 2.8 |

It can be clearly seen from the results shown in Table 8 that a high maximum density is obtainable by the process according to the invention, even when couplers are incorporated in emulsion layers.

EXAMPLE 10

A 75 mole% silver chloride-containing silver chlorobromide emulsion for use in ordinary black-and-white photographic printing paper was coated on a cellulose triacetate at one of the coverages of silver and gelatin shown in Table 9, and on the resulting emulsion layer was coated a gelatin protective layer.

Table 9

| Sample | Silver, mg/100 cm$^2$ | Gelatin, mg/100 cm$^2$ |
|---|---|---|
| A | 13 | 30 |
| B | 6 | 25 |
| C | 1.5 | 20 |

Each of the samples A, B and C was exposed through a conventional wedge and processed at 20° C. for one minute in a developer of the composition shown below. Subsequently samples A, B and C were subjected to the conventional stopping, fixing and water washing treatments to obtain samples 1, 2 and 3, respectively.

| | |
|---|---|
| Developer: | |
| Metol | 1.0 g. |
| Anhydrous sodium sulfite | 7.5 g. |
| Hydroquinone | 4.0 g. |
| Sodium carbonate monohydrate | 26.7 g. |
| Potassium bromide | 0.7 g. |
| Water to make | 1 liter |

Separately, another sample B and another sample C each were exposed in the same manner as described above, processed at 20° C. for one minute in a developer consisting of a mixture of solutions A and B of the compositions shown below, and subjected to the conventional stopping, fixing and water washing treatments, to provide samples 4 and 5, respectively.

| | |
|---|---|
| Solution A: | |
| Exemplified compound (D-13) | 4.0 g. |
| Anhydrous sodium sulfite | 4.0 g. |
| Sodium carbonate monohydrate | 25.0 g. |
| Potassium bromide | 1.0 g. |
| Water to make | 1 liter |
| Solution B: | |
| Exemplified compound (C-9) | 1.0 g. |
| Ethyl alcohol | 100 ml. |

Separately, another sample C was exposed in the same manner as described above, processed at 20° C. for one minute in a developer prepared by adding 1.5 g/liter of cobalt (III) hexaammine chloride to a color developer consisting of the above described mixture of solutions A and B, and then subjected to the same after-treatments as in the case of the other samples. The thus obtained sample is hereinafter referred to as sample 6.

Measurements of speed and maximum density were made on each of the samples 1 through 6. The results obtained are shown in Table 10.

Table 10

| Sample | Relative speed | $D_{max}$ |
|---|---|---|
| 1 | 100 | 1.4 |
| 2 | 62 | 0.6 |
| 3 | — | — |
| 4 | 108 | 1.4 |
| 5 | 102 | 1.0 |
| 6 | 105 | 1.5 |

As can be clearly seen from the results shown in Table 10, sample 4 according to the present invention exhibits as high maximum density as and higher speed than control sample 1, notwithstanding the fact that it contains only half of the silver content in control sample 1. Furthermore, it is also understood, especially from the result for sample 6, that a further saving in the amount of silver can be achieved by the combination of the process of the invention with amplification processing.

EXAMPLE 11

A 1.5 mole% silver iodide-containing silver iodobromide emulsion for roentogenographic use was coated on a polyester film at one of the coverages of silver and coupler shown in Table 11, and on the resulting emulsion layer was coated a gelatin protective film. The above-described coupler was used in the form of a dispersion prepared by dissolving exemplified compound (C-11) in DBP and protect-dispersing the solution using sodium dodecylbenzenesulfonate as dispersing agent.

Table 11

| Sample | Silver, mg/cm$^2$ | Coupler, mg/cm$^2$ |
|---|---|---|
| A | 40 | 0 |
| B | 5 | 0 |
| C | 40 | 10 |
| D | 5 | 10 |

The thus obtained samples were exposed through a wedge in the conventional manner and then subjected to the following processings.

Sample A was processed at 20° C. for 5 minutes in the same black-and-white developer as used in the preparation of sample 1 in Example 1, fixed and water washed to provide sample 1.

Another sample A and sample B were processed at 20° C. for 5 minutes in a developer consisting of a mixture of solutions A and B of the compositions shown below, fixed and water washed to provide samples 2 and 3, respectively.

| | |
|---|---|
| Solution A: | |
| Exemplified compound (D-1) | 5.0 g. |
| Anhydrous sodium sulfite | 20.0 g. |
| Anhydrous sodium carbonate | 50.0 g. |
| N-Methylbenzothiazolium-p-toluenesulfonate | 1.0 g. |
| 1-Phenyl-5-mercaptotetrazole | 0.2 g. |
| Water to make | 1 liter |
| Solution B: | |
| Exemplified compound (C-5) | 6.5 g. |
| Ethyl alcohol | 100 ml. |

Another sample B was processed at 20° C. for 5 minutes in a developer consisting of a mixture of the above-described solutions A and B, then processed at 20° C. for 6 minutes in a hydrogen peroxide bath prepared by adding water to 25 ml. of a 33% aqueous hydrogen peroxide solution to the total volume of 1 liter and adjusting the resulting solution to pH 9.0, and finally subjected to fixing and water washing to provide sample 4.

Samples C and D each was processed at 20° C. for 5 minutes in a developer consisting exclusively of the above-described solution A, fixed and water washed to provide samples 5 and 6, respectively.

Sample D was processed at 20° C. for 5 minutes in a developer consisting exclusively of the above-described solution A, then processed at 20° C. for 6 minutes in the same hydrogen peroxide bath as used in the preparation of the above-described sample 4, and finally subjected to fixing and water washing to provide sample 7.

Measurements of fog and $D_{max}$ were made on each of the samples 1 through 7. The results obtained are shown in Table 12.

Table 12

| Sample | Fog | $D_{max}$ |
|---|---|---|
| 1 | 0.04 | 1.1 |
| 2 | 0.04 | 2.2 |
| 3 | — | — |
| 4 | 0.05 | 2.5 |
| 5 | 0.03 | 2.6 |
| 6 | — | — |
| 7 | 0.07 | 2.9 |

As can be seen from the results shown in Table 12, by practicing the process according to the present invention in combination with the amplification processing by means of an aqueous hydrogen peroxide solution, markedly high maximum densities can be obtained even when the silver amount of 5 mg/100 cm$^2$, which is one-eighth that used in control sample 1, is used. In other words, a further saving in the amount of silver can be achieved by combination of the process of the present invention with amplification processing.

What we claim is:

1. A process for the production of a dye image on a light-sensitive silver halide photographic material which comprises imagewise exposing said material to light and developing said material in the presence of both a polyfunctional coupler selected from the group consisting of Resorcin, 2,2'-Dihydroxybiphenyl, 5-Amino-α-naphthol, N,N'-Bis(3-hydroxyphenyl)ethylenediamine, 1-Phenyl-3-(1-hydroxy-2naphthamido)pyrazolin-5-one, N,N'-Bis[1-(4-sulfophenyl)-pyrazolin-5-one-3-yl]-malondiamide, α-Acetyl-3-hydroxyacetoanilide, N,N'-Methylenebis(1-hydroxy-2-naphthamide), 2,2'-Methylenebis(8-hydroxyquinoline), 2,2'-Methylenebis[6-(2-hydroxyphenyl)phenol], N,N'-Bis[2-hydroxy-4-(2',4'-di-tert.-amylphenoxy acetamido)phenyl]malondiamide, 2,2'-Methylenebis(4-chlorophenol), 3,3'-Diphenylamine, 3-Aminophenol, 3-Anilinophenol, 3-(N-Methyl)aminophenol, and a compound selected from the group consisting of N,N'-Ethylenebis(3-methyl-4-amino-N-methylaniline), β,β'-Oxybis[β-(N-ethyl-4-aminoanilino)ethyl]ether, N,N'-Ethylenebis[4-amino-N-(β-hydroxyethyl)aniline], 4-Amino-N-ethyl[β-(4'-amino-N'-ethylanilino)propionic acid]anilide, 2,2'-Methylenebis(p-phenylenediamine), 2-Amino-5-[N-ethyl-N-(β-methoxyethyl)]amino-phenethyl{2-amino-5-[N-ethyl-N-(β-methoxyethyl)]}-aminobenzylsulfonamide, N[2-(N,N-diethylamino)-5-aminophenethyl]-2-amino-5-(N,N-diethylamino)-phenylaniline, 2-[β-{2-amino-5-(N,N-diethylamino)-phenoxy}ethyl]-4-amino-N,N-diethylaniline, Bis(2-hydroxy-5-aminobenzyl)amine, 2,2'-Methylenebis(p-aminophenol), N-(2'-hydroxy-5'-aminophenyl)-2-hydroxy-5-amino-benzylamine, α,α'-(Ethylenediimino)-bis-(4-amino-o-cresol), 3-Methyl-4-amino-N-ethyl-N-(2-hydroxy-5-aminobenzyl)aniline, α,α'-Oxybis(4-amino-o-cresol), 5-Aminosalicylic acid (2-amino-5-hydroxy)anilide, 2,2'-Disulfidebis(p-aminophenol), 2,6-Bis(2-hydroxy-3-methyl-5-aminobenzyl)-3,5-dimethyl-4-aminophenol.

2. The process according to claim 1 wherein said material contains said polyfunctional coupler.

3. An aqueous alkaline photographic developing solution comprising a compound selected from the group consisting of N,N'-Ethylenebis(3-methyl-4-amino-N-methylaniline) β,β'-Oxybis[β-(N-ethyl-4-aminoanilino)ethyl]ether, N,N'-Ethylenebis[4-amino-N-(β-hydroxyethyl)aniline], 4-Amino-N-ethyl[β-4'amino-N'-ethylanilino)-propionic acid]anilide, 2,2'-Methylenebis(p-phenylenediamine), 2-Amino-5-[N-ethyl-N-(β-methoxyethyl)]amino-phenylethyl{2-amino-5-[N-ethyl-n-(β-methoxyethyl)]}-aminobenzylsulfonamide, N[2-(N,N-diethylamino)-5-aminophenethyl]-2-amino-5-(N,N-diethylamino)phenylaniline, 2-[β-{2-amino-5-(N,N-diethylamino)phenoxy}-ethyl]-4-amino-N,N-diethylaniline, Bis(2-hydroxy-5-aminobenzyl)amine, 2,2'-Methylenebis(p-aminophenol), N-(2'-hydroxy-5'-aminophenyl)-2-hydroxy-5-amino-benzylamine, α,α'-(Ethylenediimino)-bis(4-amino-o-cresol), 3-Methyl-4-amino-N-ethyl-N-(2-hydroxy-5-aminobenzyl)aniline, α,α'-Oxybis(4-amino-o-cresol), 5-Aminosalicylic acid (2-amino-5-hydroxy)anilide, 2,2'-Disulfidebis(p-aminophenol), 2,6-Bis(2-hydroxy-3-methyl-5-aminobenzyl)-3,5-dimethyl-4-aminophenol.

* * * * *